114-1 SR
12/23/86 OR 4,630,561

United States Patent [19]

Franz et al.

[11] Patent Number: 4,630,561

[45] Date of Patent: Dec. 23, 1986

[54] SHIP HAVING STANDARDIZED ACCESS WAYS

[75] Inventors: Hans-Joachim Franz, Kölln-Reisiek; Willy Schmidt, Ellerbek; Karl O. Sadler, Hamburg, all of Fed. Rep. of Germany

[73] Assignee: Blohm & Voss AG, Hamburg, Fed. Rep. of Germany

[21] Appl. No.: 716,566

[22] Filed: Mar. 27, 1985

Related U.S. Application Data

[63] Continuation-in-part of Ser. No. 580,611, Feb. 16, 1984.

[30] Foreign Application Priority Data

Mar. 27, 1984 [DE] Fed. Rep. of Germany ..... 3411299

[51] Int. Cl.[4] ..... B63G 1/00; B63B 3/00

[52] U.S. Cl. ..... 114/1; 114/65 R; 114/85; 114/201 R

[58] Field of Search ..... 114/1, 72, 65 R, 85, 114/73, 201 R

[56] References Cited

U.S. PATENT DOCUMENTS

| | | | |
|---|---|---|---|
| 2,585,134 | 2/1952 | Kennedy | 114/201 |
| 3,414,145 | 12/1968 | Calabrese | 114/72 X |

FOREIGN PATENT DOCUMENTS

| | | |
|---|---|---|
| 977480 | 4/1951 | France . |
| 1564530 | 4/1969 | France . |
| 613413 | 11/1948 | United Kingdom . |
| 1418841 | 12/1975 | United Kingdom . |
| 2135248 | 8/1984 | United Kingdom . |

*Primary Examiner*—Sherman D. Basinger
*Attorney, Agent, or Firm*—Nils H. Ljungman

[57] ABSTRACT

On a ship, the longitudinal beams and the framework girders of different decks or of the inside bottom are arranged in identical vertical planes. In at least some of the rectangles defined by the longitudinal beams and the framework girders, there are access openings located vertically above one another. The openings in a vertical group are practically all the same size and aligned with one another vertically. Between corresponding junction points of the longitudinal beams and the framework girders above one another, vertical props running intercostally are located at the corners of each access opening. At least the third and subsequent access openings from the top are closed, preferably in a water-tight manner, by identically-sized removable access covers having at least two pieces each.

29 Claims, 9 Drawing Figures

SHIP HAVING STANDARDIZED ACCESS WAYS

CROSS REFERENCE TO CO-PENDING APPLICATION

Co-pending application Ser. No. 580,611 filed on Feb. 16, 1984 entitled "Ship With Several Decks Having Longitudinal And Lateral Support Elements Arranged In A Grid", having the same inventors and assigned to the same assignee as the instant application, and of which the instant application forms a continuation in-part thereof, describes a maritime structure such as a warship.

BACKGROUND OF THE INVENTION

1. Field of the Invention

The invention relates to a ship, specifically a naval vessel, with several decks, preferably located above one another, which decks are supported on longitudinal beams running in the longitudinal direction of the ship and framework girders running transverse to the ship.

2. Description of the Prior Art

The installation and removal, specifically of rather large components, is becoming increasingly difficult on ships especially because of an increase in packing density of equipment to be installed inside modern naval vessels. This becomes even more important, the farther inside the ship the components in question must go and the bigger the components become. It is known that access openings and access routes especially designed and aligned can be provided for this purpose inside the hull of the ship.

For each different type of ship, the access openings and access routes must be determined and established in time-consuming tests, on the basis of the equipment, apparatus, pallets, etc., to be installed. This results in a series of disadvantages, both in the area of design and fabrication.

One of these disadvantages consists of the non-uniform dimensions of the access openings which must fit the type of ship and also must take into account strength requirements for the ship on the one hand, and the access routes which are required by the positioning of the equipment, apparatus, etc., on the other hand. As a result, in many cases access openings cannot be located vertically above one another. In many cases, only welded access openings can be considered, and this results in limitations on the maximum size of components to be incorporated, which necessarily has a negative impact on the development of large functional units to be introduced into the ship.

On the occasion of the initial assembly of apparatus and equipment in a ship, with weldable access openings, for example, there are problems during fabrication, because spaces, compartments, etc., can only be completely finished after the final pieces of equipment have been introduced. Only then can the access openings be welded shut.

If apparatus and equipment must subsequently be removed and replaced for repair, conversion, etc., the secondary costs, for example, for the removal of welded access openings and the clearance of access routes, or the removal of pieces of insulation, pipelines, pipe hangers, cables, etc., often come to several times the cost of the removal and replacement of the equipment to be replaced, strictly speaking.

Furthermore, the welding work required to free the access paths can lead to a deformation of the hull of the ship and, under certain circumstances, it may be necessary to move and/or re-adjust ship-reference equipment, for example weapons, sensors, machines, etc.

OBJECT OF THE INVENTION

The object of the present invention is therefore to provide a ship in which it is possible to erect and remove equipment, machines, frames, pallets, containers, etc., with comparatively little effort inside the ship, through all the decks, down to the inside bottom, so that it is possible to introduce components with predetermined maximum dimensions simply and easily by means of a crane and a horizontal transportation system.

SUMMARY OF THE INVENTION

This objective is achieved by the invention, due to the fact that the longitudinal beams and framework girders of different decks or of the inside bottom are each arranged in predetermined vertical planes. In at least some of the rectangles defined by longitudinal beams and framework girders, there are access openings located vertically above one another in all decks and connected with one another. The uppermost access openings are of the same size as, or slightly larger than, the lower access opening or openings. Furthermore, under each uppermost opening the topmost lower access opening is closed in a water-tight manner by a one-piece access cover and the second access opening from the top is closed in a water-tight manner by a one-piece or at least two-piece cover. The invention is preferably used on ships with at least three decks one above the other and, in this preferred embodiment, is characterized by the fact that at least the access openings located underneath the uppermost access opening are all of the same size. In the preferred embodiment, at least the third and subsequent access openings from the top are closed, preferably in a water-tight manner, by removable access covers, all of the same size, and having at least two parts.

It is especially advantageous if, between the corresponding junction points of the longitudinal beams and framework girders located above one another, props running intercostally are located preferably at the corners of each access opening. These props connect the individual decks with one another.

In accordance with the invention, therefore, all the access openings located vertically above one another, except the topmost, are of the same size and are aligned vertically with one another. Furthermore, the access opening arrangements increase the structural strength of the ship, by providing the vertical props in the corners of the access openings or at the junction points of the longitudinal beams and framework girders. Between the vertical props, however, there is sufficient space for the horizontal movement of introduced components.

So that the props which stand on the bottom-most double bottom of the ship are not able to push the weapons located on the topmost deck from their foundations when the ship runs aground or when there is a detonation pressure which acts from below, the props should be equipped at least at the junction points between the double bottom floor and the deck above it with shock absorbers. Preferably, the shock absorbers could also be interposed in the props located between the decks above.

Because of the configuration described by the invention, it is generally possible to combine equipment, apparatus, etc., into rather large functional units and place them in the ship, whereby many repair activities can be performed outside the ship. This results in improved quality and time saved, because of the possibility of parallel fabrication and repair. There are also savings during the on-board erection. Before the introduction of the components, the rooms and deck areas in question can be completed, for example, the insulation, pipelines, cables, and cable tracks can be completed by the time the equipment, apparatus, functional units, etc., are simply and economically installed. Finally, the access openings can be easily covered by a standard access cover and sealed in a water-tight manner.

This means that over the fitting time of the ship, there is a significant improvement of the installation conditions for pipeline materials, too, such as pipes, insulation, etc. Because of the configuration proposed by the invention, very large functional units can easily be placed inside the ship, by first of all admitting them vertically through the appropriately-sized access openings, and then moving them horizontally along and between the ship decks as necessary, whereby the functional unit may be almost as high as the distance between the two decks above one another, that is they may have the maximum possible size. Since the installed functional units can therefore be designed to be significantly larger and more voluminous, it is also possible to achieve a reduction in the construction time, since significantly more apparatus, lines, pipes, equipment, etc., can be combined beforehand into compact functional units and can be preassembled outside the ship. This results in a further general reduction of construction time. Of special significance is the special execution of an overlapping foundation (deck/access cover), whereby after the access cover is installed, the deck is practically continuously flush thereacross. Therefore, objects, pieces of equipment, etc., can be pushed along it horizontally and a full load can be applied even in the vicinity of the access cover.

The user of the system described by the invention is also offered other significant advantages on the occasion of repair activities, maintenance operations, conversions or retrofitting operations. It is possible to remove and re-install large parts, pieces of equipment, etc., in a minimum amount of time and at minimum cost, and without damaging effects to the ship as a whole.

Therefore, according to the invention, ships with a high equipment packing density, such as naval ships, can be equipped with standardized, bolted access openings which can be located vertically above one another. The longitudinal beams and framework girders which are fundamentally present in a ship, however, are systematized in their configuration, for example, the main framework girders are arranged transverse to the longitudinal axis of the ship and the longitudinal beams parallel to the longitudinal axis of the ship are located in given planes as a function of the access openings located in the topmost deck. At the resulting junction points which are vertically above one another, props which run intercostally from the topmost to the lowest deck are installed. The unsupported beam lengths can thereby be reduced, and sidewalls and transverse walls can theoretically be eliminated, which has an overall positive effect on the structural strength of the ship.

Only by the systematic design of the ship in accordance with the present invention is it possible to provide closable access openings of a significant size and number.

A first preferred embodiment is characterized by the fact that the uppermost access opening is designed to be just sufficiently larger than the second access opening from the top so that the second access cover can fit right through the uppermost access opening.

It is also advantageous if the uppermost access cover, which preferably supports a functional unit such as a weapon or location equipment, rests on a unit foundation which projects upward from the uppermost deck and surrounds the access opening. This unit foundation is erected on the longitudinal beams or framework girders. The projection of the unit foundation above the uppermost deck causes no problems, because it has yet another superstructure on top.

With regard to the access openings below the uppermost deck, however, the preferred arrangement has the access openings of the deck below the uppermost deck as flush deck access openings, for example, the corresponding access covers are rigidly mounted on flush deck unit foundations with the deck in question. The foundations in this case are attached on the inside to the longitudinal beams or framework girders, so that the access covers used are rigidly connected with the adjacent deck. Since the uppermost access opening is preferably somewhat larger than the access openings below it, the second access cover from the top can be one piece, since it just fits through the uppermost access opening.

Otherwise, the embodiment is appropriately designed so that the access cover located below the second access opening from the top is an abbreviated partial cover and an adapter which covers the rest of the access opening. Specifically, in this arrangement, the adapter is designed on three sides for placement on the flush deck foundation and on the side facing the partial cover as a hatch beam to support the partial cover.

The partial cover is significantly longer than the adapter; the preferred length ratio is approximately 2:1.

The size and number of access openings along the hull are primarily determined by the transverse bulkheads present so that, preferably, there is one set of access openings above one another for each two succeeding transverse bulkheads.

In addition, the size and configuration of the access openings is determined by the fact that on each side of each access opening to the hull or the adjacent transverse bulkheads, there is only one space available, the surface area of which may be smaller than, essentially the same as, or somewhat larger than the surface of the access opening.

It is of special importance for the introduction of large components into the hull if, apart from the props in the space between the access openings and the transverse bulkheads or the hull, there are no load-bearing walls. In this manner, the entire space between two transverse bulkheads and the hull walls, with the exception of the props provided at the corners of the access openings, is available for components to be pushed freely in the horizontal direction.

Since the access openings according to the invention can be made relatively large and can have dimensions, for example, of 3 or even 4 meters, it is sufficient if there is a series of sets of access openings of the same size only along the central longitudinal axis of the ship.

So that the access covers used can also be used for the erection of equipment, etc., the deck and access cover reinforcements lie in the same plane and are aligned longitudinally and transversely with one another.

So that the equipment mounted on a given deck can be horizontally configured, including the access cover, there should be vertically-adjustable standard foundations at the junction points of the reinforcements.

To be able to horizontally move components introduced from above onto a given access cover by means of a crane, these components are provided, at least temporarily, with wheels, where appropriate, which can then run on transport rails, which can be laid on the standard foundations.

BRIEF DESCRIPTION OF THE DRAWINGS

The invention is explained below by way of example with reference to the drawings.

DESCRIPTION OF THE PREFERRED EMBODIMENTS

Figure 1:
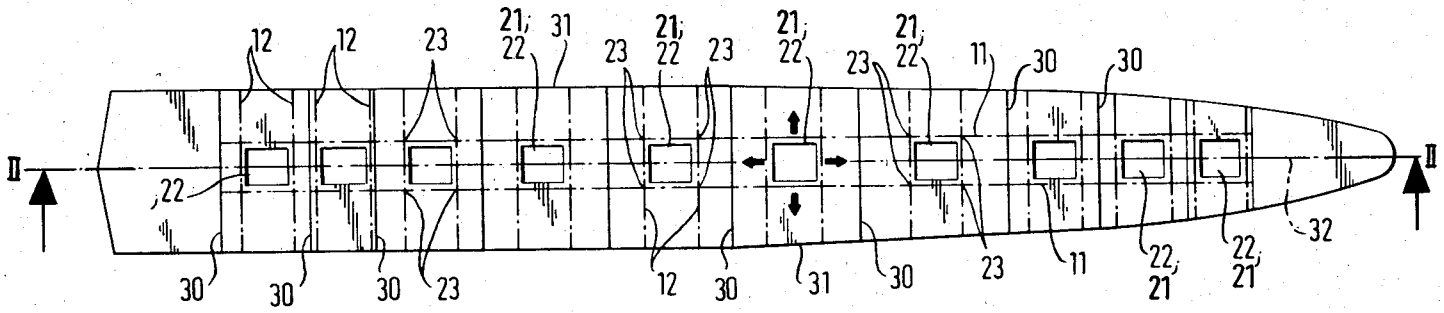
FIG. 1 shows a schematic overhead view of a ship according to the invention.
Figure 2:
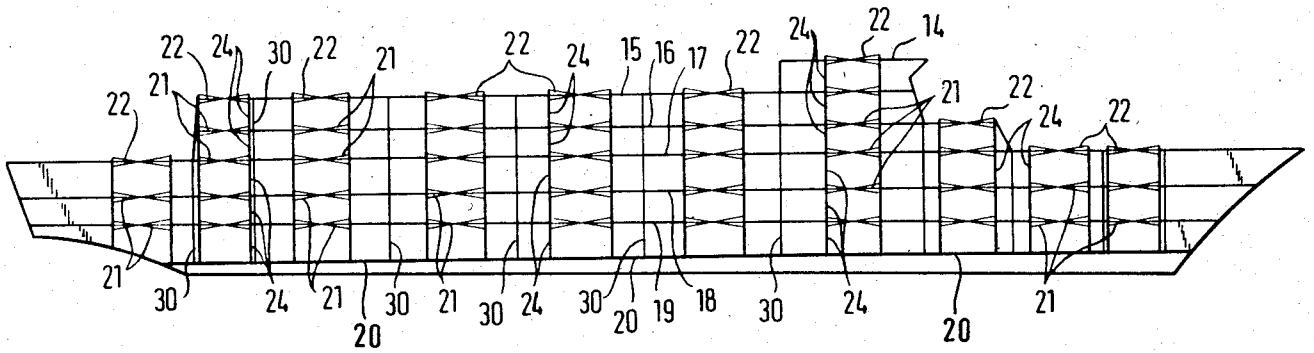
FIG. 2 shows, in partial section, a side view of the ship according to the invention.

As shown in FIGS. 1 and 2, a hull, for example 15 m wide, having two sides 31, is divided at intervals of approximately 10 m or less by transverse bulkheads. There are longitudinal beams 11 along each and every deck of the ship symmetrical to the longitudinal central line 32 of the ship at a lateral interval of approximately 4 m. Between each two succeeding transverse bulkheads 30, at a distance of somewhat more than 4 m, on each deck there are also two crosswise framework girders 12. In this manner there are a total of four junction points 23 of longitudinal beams 11 and framework girders 12 formed on each deck between two succeeding transverse bulkheads 30. The regions of the longitudinal beams and framework girders which run between two junction points 23 define rectangular access openings 21, which are vertically above one another and essentially all of the same size in all the decks 14, 15, 16, 17, 18, and 19 above one another, and aligned with one another so that continuous access shafts which run from top to bottom are formed. Only the uppermost access opening 22, which is always located in the topmost deck 14, is also vertically aligned with the access openings 21 below it. The uppermost access opening 22 is designed, in a manner to be described in greater detail below, to be somewhat larger than the access openings 21 below it. Especially along a central longitudinal line 32 of the ship, the uppermost access openings 22 are preferably all of the same size.

In the following figures, the parts are identified with the same reference numbers as in FIGS. 1 and 2.

Figure 3:
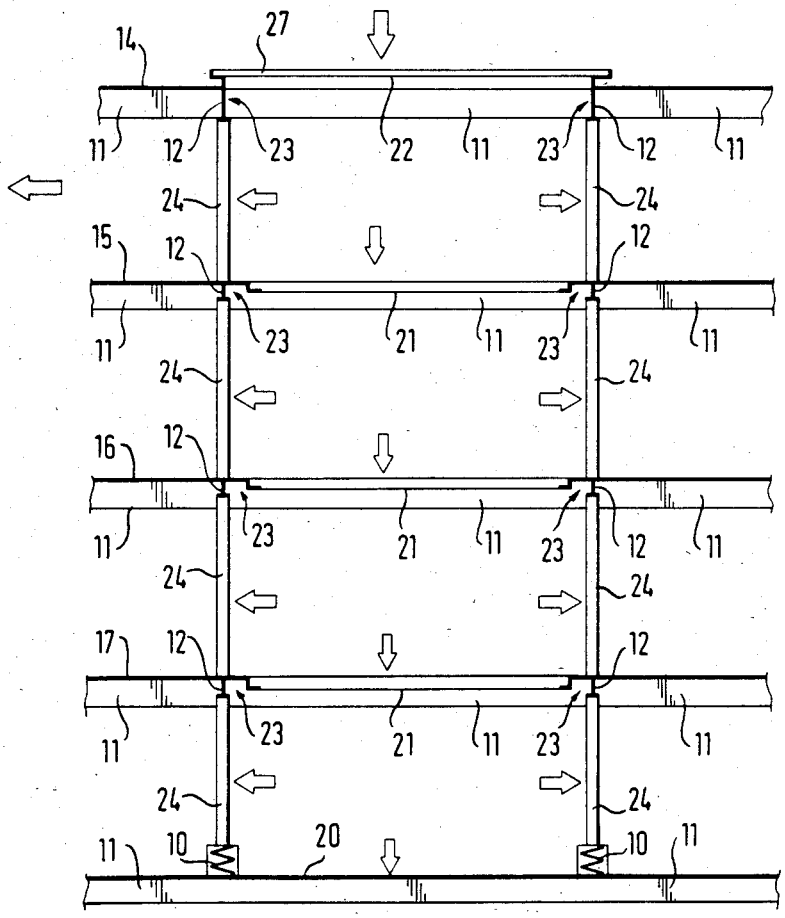
FIG. 3 shows an enlarged partial side view, in partial section, of a ship according to the invention.

As shown in FIGS. 2 and 3, props or columns 24 run intercostally between the junction points 23 of decks located above one another, whereby in the vicinity of the access openings 21 and 22 the structural strength of the ship is significantly increased.

Between the lowest deck 19 (as shown in FIG. 2) or 17 (as shown in FIG. 3) and the inside bottom 20, there are vertical supports or props 24 at the junction points 23. The props 24 are rigidly connected, specifically welded, to the longitudinal beams 11 or framework girders 12.

Figure 4:
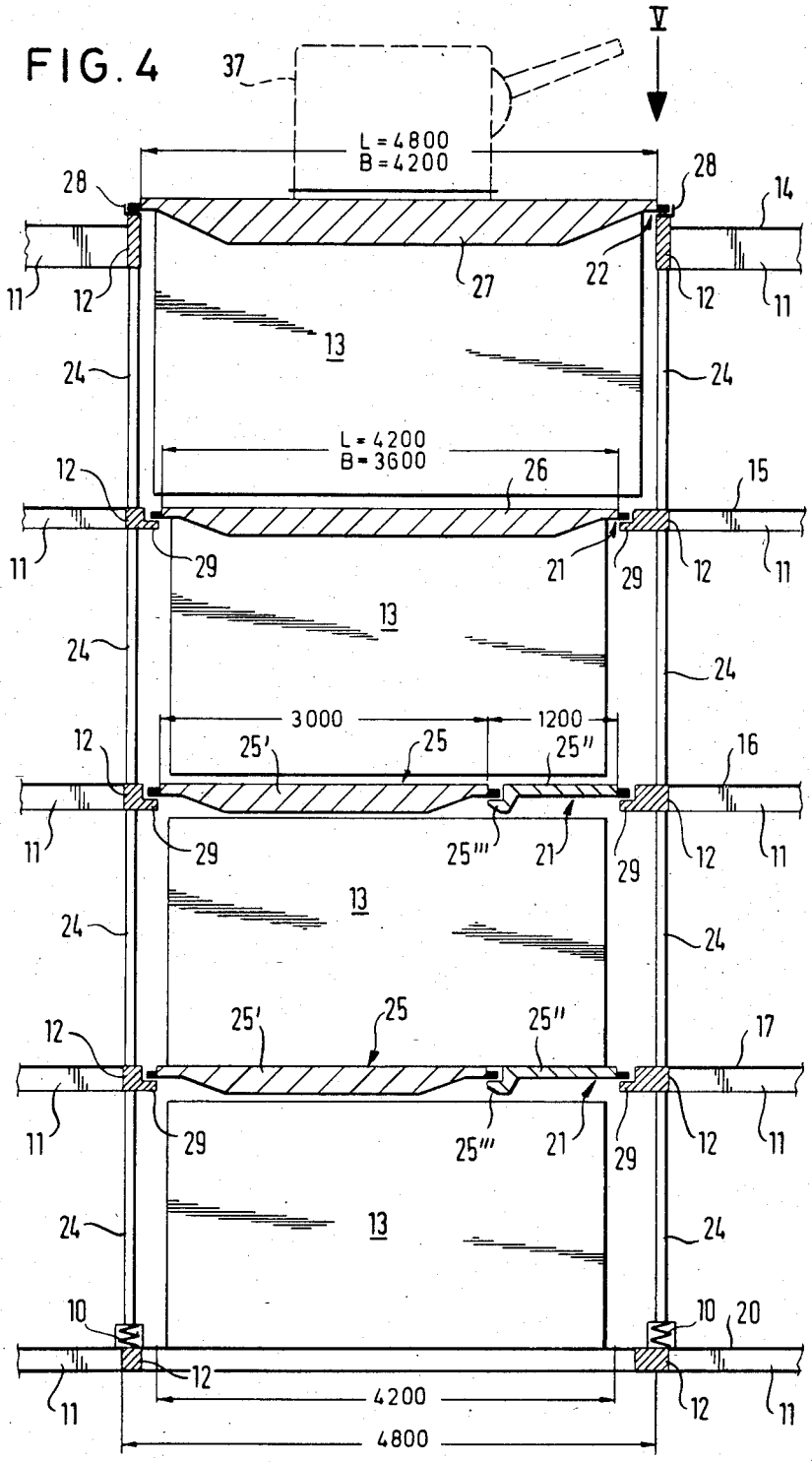
FIG. 4 shows a more detailed representation of the ship illustrated in FIG. 3, to show the structural configuration of the access cover.

As shown in FIGS. 3 and 4, the topmost access opening 22 is closed in a water-tight manner by means of a one-piece access cover 27, which is designed as a stable, load-bearing unit platform, which rests on a unit foundation which surrounds the access opening 22. The unit foundation projects upward somewhat from the topmost deck as shown in FIG. 4 and supports a functional unit, for example, a weapon 37, which is indicated by dotted lines. A cuboid-shaped equipment container 13 is shown fastened to the bottom of the access cover 27.

The second access opening 21 from the top is aligned vertically with the topmost access opening 22, but its periphery is somewhat smaller than that of the access opening 22, so that the access cover 26 can be placed so that its surface is rigidly connected and flush with the deck 15. The access cover 26 is water-tight and comprises preferably a one-piece cover or alternatively a two-piece cover. The uppermost access opening 22 is preferably just sufficiently larger than the second access opening 21 to allow the access cover 26 to fit therethrough.

The other access openings 21 underneath in the decks 16 and 17 are designed to be the same size and are provided with identical flush deck foundations 29. But they are covered in a water-tight manner by two-piece covers 25, which comprise a longer partial cover 25′ and an adapter 25″ which covers the remainder of the access opening 21. The adapter 25″ has three sides against the flush deck foundation and is rigidly mounted on the deck 16 or 17. On the fourth side, it has on the inside, hatch beams 25‴ pointing downward, with which the free side of the partial cover 25′ is in contact in a manner analogous to the flush deck foundation 29. Therefore, the partial cover 25′ is connected with the adapter 25″ and the total cover 25 with the deck 16 and 17. The covers 25 and partial covers 25′ and adapters 25″ preferably are all of the same size. The length ratio of the partial cover 25′ and the adapter 25″ is approximately 2:1. The deck height is approximately 250 cm. Other preferred dimensions (in mm) are indicated in FIG. 4. As can be seen in FIGS. 3 and 4, according to the invention, between the lowest double bottom 20 and the props 24 leading to the deck above it, there is always a shock absorber 10, so that in case of a deformation of the double bottom 20 when the ship runs aground or if a detonation occurs, a deformation of the deck above it and specifically the foundation plane of the weapon 37 located on the topmost deck can be prevented. If necessary, there can also be other shock absorbers inside the props 24 located above.

Between each set of transverse bulkheads 30 there is preferably always a set of access openings. Also, there are preferably no load bearing members except for the bulkheads 30 and the props 24.

In the embodiment illustrated in FIGS. 1 to 4, for example containers or equipment containers 13 (as shown in FIG. 4), when the access covers 25, 26, and 27 are removed, can be placed by a crane down to the inside bottom 20. The cross section of the container 13 can be as large as the cross section of the access openings 21, while its height may essentially correspond to the distance between decks.

Figure 5:
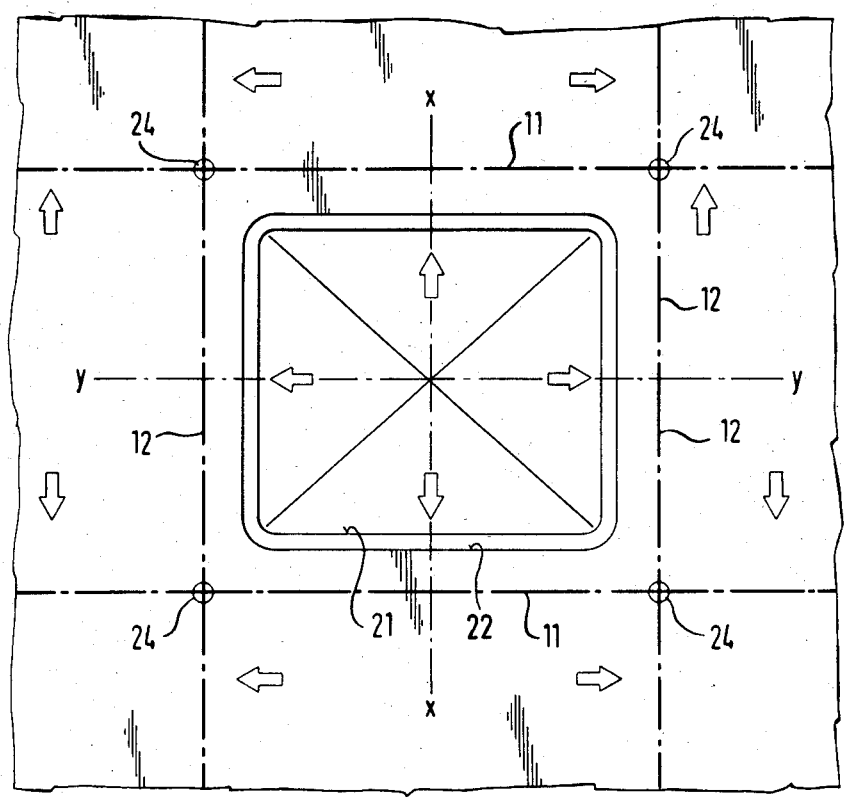
FIG. 5 shows an overhead view of an access opening with the corresponding surrounding area.

After the introduction of a container, for example on the inside bottom, the container (as shown in FIG. 5) can be transported in the direction of the arrows as necessary to its final location. The only obstacle to this movement along an x-y coordinate system is made up of the vertical props 24, the interval between which must be designed so that they interfere as little as possible with the movement of a container 13. In special cases, one or more of the props 24 could also be fastened so that they could be removed.

Once all the equipment and/or containers to be placed on the inside bottom 20 have been introduced and, if necessary, pushed to their positions inside the ship, the lowest access cover 25 can be placed in the access opening 21 of the deck 17. If necessary, the adapter 25'' can also be placed in its desired position, after which the partial cover 25', which fits easily through the access openings 21 and 22 above one another, covers the remainder of the access opening. Finally then, the cover 25 is suitably fastened to the longitudinal beams 11 and the framework girders 12 or to the flush deck foundation 29, so that it forms a stable unit with the adjacent deck.

In a corresponding manner, the equipment and/or containers 13 for the decks 17, 16 and 15 can then be introduced one after the other, after which the corresponding access openings 21 are always closed with the covers 25 and 26 provided for that purpose. Finally, after the arrangement of the equipment to be fastened on the deck 15, the unit platform 27 is placed with the functional unit 37 on the topmost deck 14 and fastened there. While the two lower containers 13 rest on the inside bottom 20 and on the lowest deck 25 respectively, the third container 13 is suspended below the access cover 26. In this case, the container 13 is also automatically secured with the fastening of the cover 26.

Figure 6:
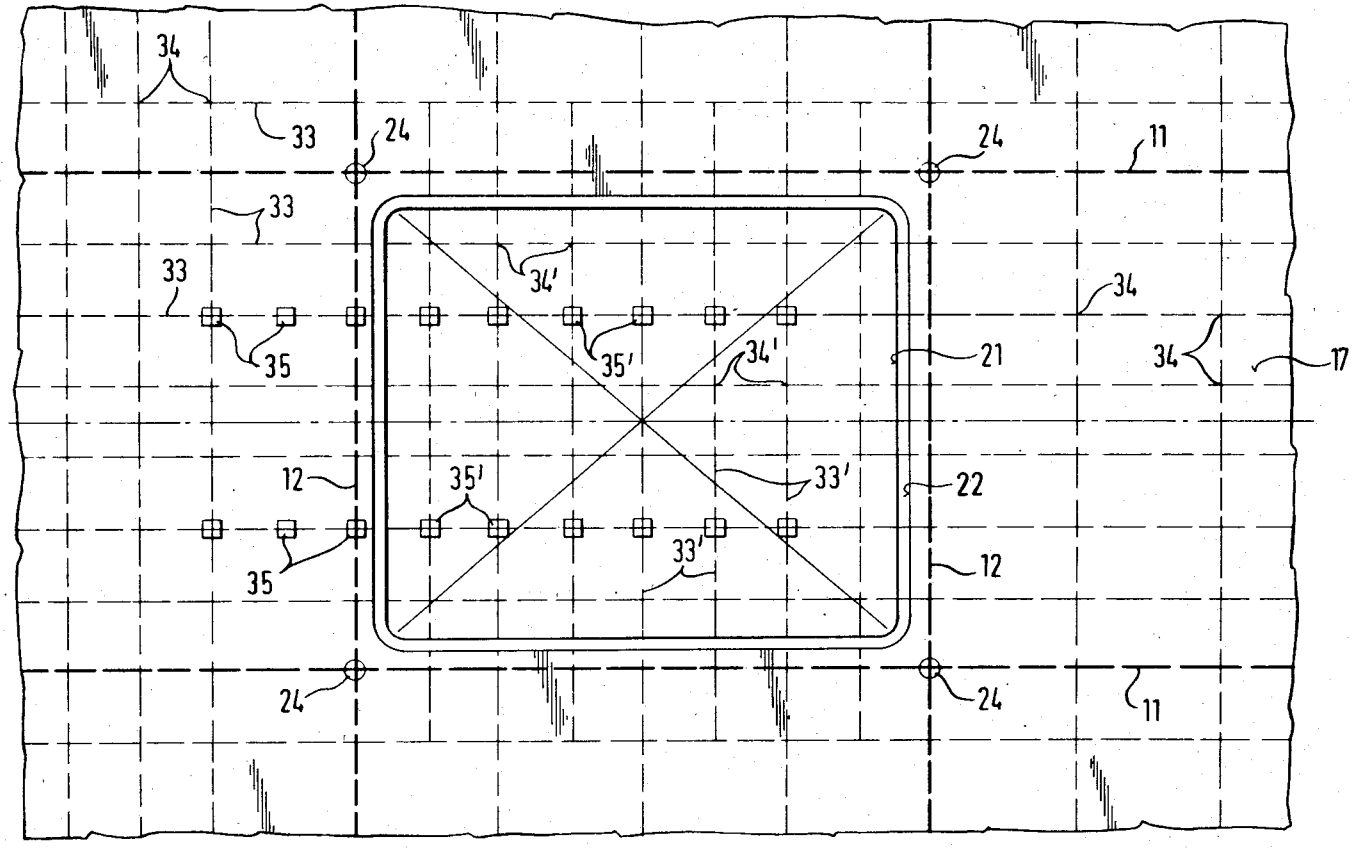
FIG. 6 shows an overhead view similar to FIG. 5, to show the deck and access cover reinforcements.
Figure 8:
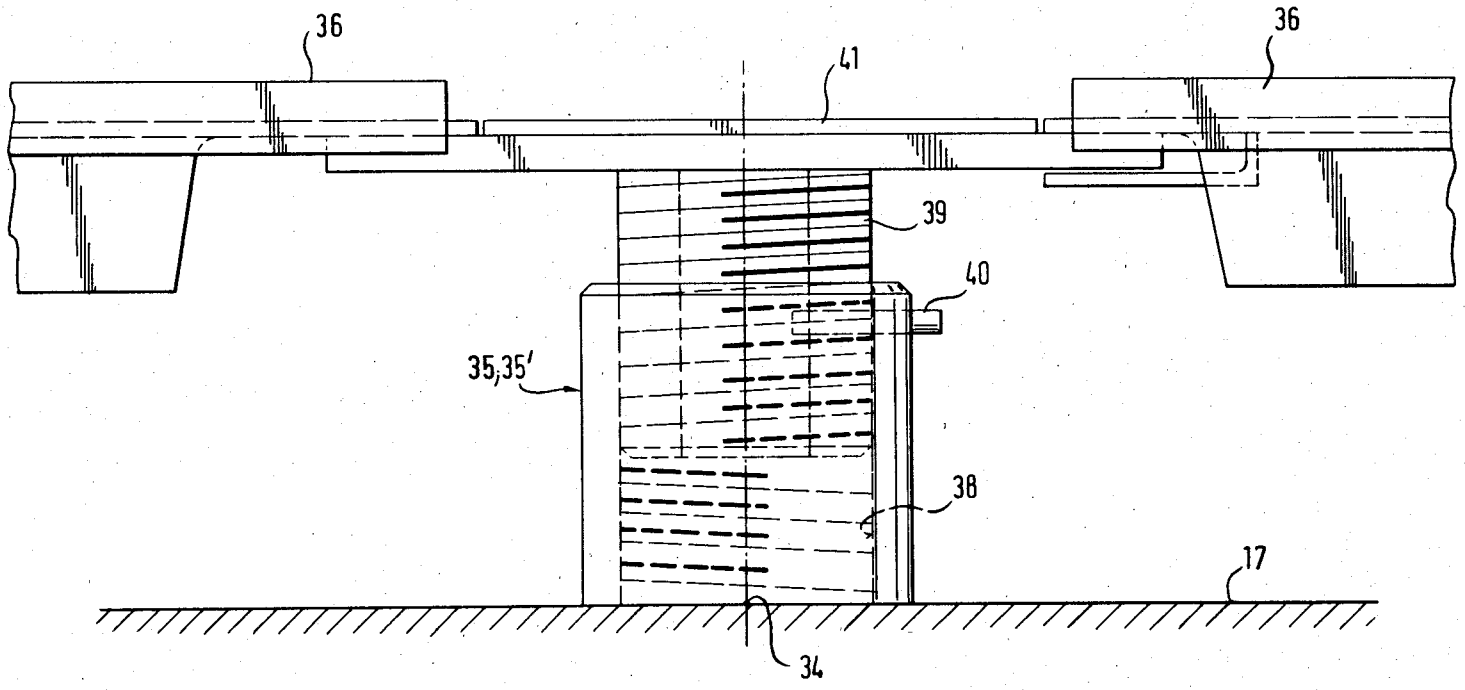
FIG. 8 shows an enlarged side view of the standard foundations with the transport rails located on them.

As shown in FIG. 6, both the decks, for example 17, and the access cover, for example 21, are provided with deck or access reinforcements 33 and 33'. The deck reinforcements are configured according to a rectangular or square pattern to correspond to the longitudinal beams 11 and the framework beams 12. The access cover reinforcements 33' are aligned with the deck reinforcements. Standard foundations 35 or 35' can be attached at the junction points 34 or 34'. As illustrated in FIG. 8, each standard foundation 35 comprises a foot equipped with an internally-threaded hole 38 and a tie bolt 39 screwed inside it, which can be set by means of a locking bolt 40 at a given height. Above, supplied by a bolt 39, there is a transposition plate 41, which can be set in a pre-determined horizontal plane by screwing the bolt 39 out or in. On these transposition plates 41, any desired number of which can be provided on each deck 14 to 19 or on the inside bottom 20, the equipment, etc., to be installed is fastened as necessary.

Figure 7:
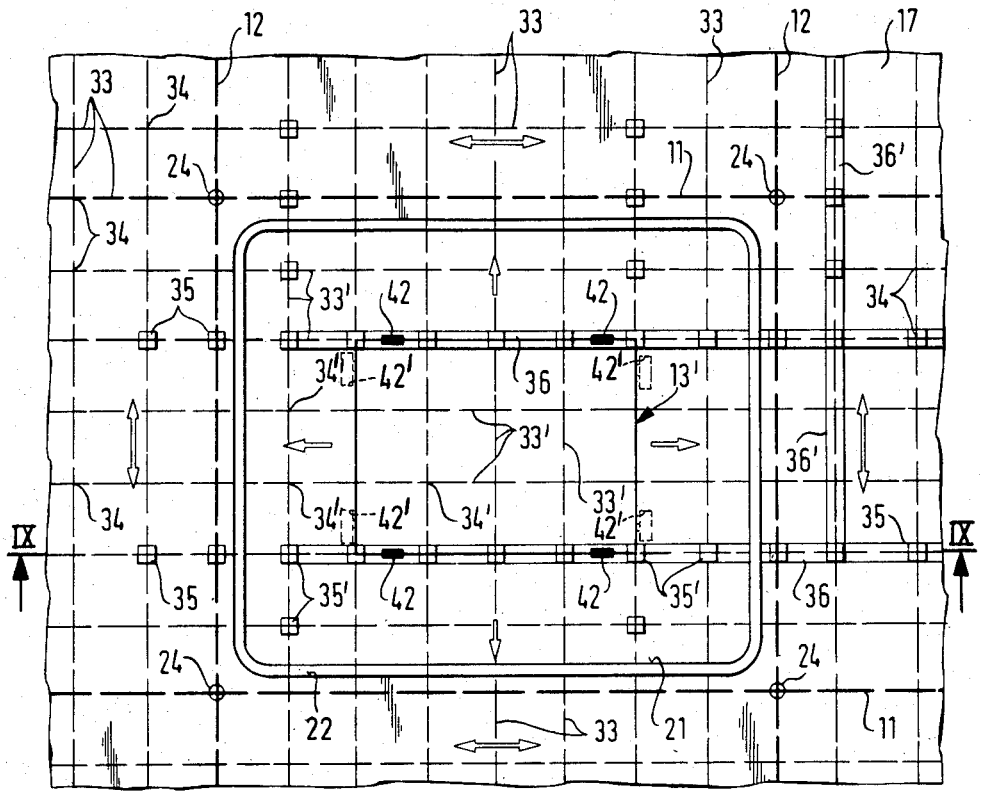
FIG. 7 shows a view similar to FIG. 6, to show the arrangement of transport rails.
Figure 9:
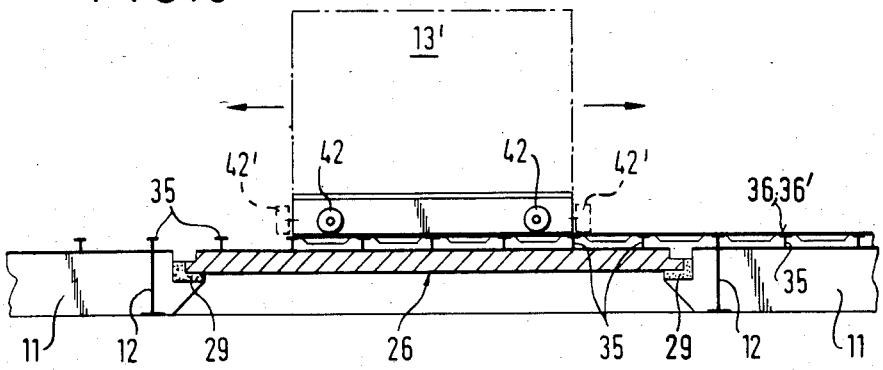
FIG. 9 shows a schematic side view of a deck in the vicinity of an access opening with a portable pallet located on the access cover.

As shown in FIGS. 7 and 8, transport rails 36 or 36' can be placed in a series of standard foundations 35 or 35', on top of which (as shown in FIG. 9) a pallet 13' equipped with wheels 42 can be placed. In this manner the pallets, after they have been placed on the transport rails 36 provided on the access cover 26, can be pushed to the adjacent deck, for example 17, where they can then be attached in a suitable manner to the standard foundations.

According to the invention, therefore, the access covers 25, 26 and 27 are designed not only to provide a water-tight closure for the access openings, but to simultaneously form a continuous, stable installation surface with the surrounding decks 14 to 19 for equipment and other components, whereby a continuous square or rectangular grid of deck reinforcements 33 and 33' is to be provided with standard foundations 35 and 35' at the junction points 34 and 34'. After an access cover is placed and fastened in the corresponding access opening, the installed equipment can therefore be freely moved horizontally in all directions, whereby only the four props 24 at the corners of the access opening need be taken into consideration. It is therefore decisive for the function of the horizontal transport system according to the invention that the deck or access cover reinforcements lie in the same plane. Only by this means is it possible to locate, at the junction points or at uniform intervals, horizontally-adjustable standard foundations 35 and 35', which are used on the one hand to fasten equipment, pallets, etc., and on the other hand to support transport rails 36. The movement of equipment, pallets, etc., is carried out by means of removable rollers on the transport rails which run horizontally crosswise or lengthwise. Once a pallet 13' is pushed in a given direction, the wheels on one side can be removed and, as shown in FIG. 9, be fastened in position 42', whereupon it is possible to move the equipment at a right angle to the previous direction of movement, for example, on the transport rails 36' in FIG. 7.

The invention as described hereinabove is not to be taken as limited to all of the provided details thereof, since modifications and variations thereof may be made without departing from the spirit and scope of the invention.

What is claimed is:

1. In a ship having a plurality of vertically spaced decks and a ship bottom within a hull, said decks comprising an uppermost deck and lower decks, said hull having a longitudinal direction and a transverse direction, an assembly arrangement for equipment and apparatus, said arrangement comprising:

a plurality of substantially horizontal load bearing elements comprising a plurality of longitudinal members substantially parallel to said longitudinal direction and a plurality of transverse members transverse to said longitudinal members, substantially parallel to said transverse direction, said longitudinal members and said transverse members supporting said plurality of decks;

at least a substantial portion of said longitudinal members defining a plurality of vertical longitudinal planes and being disposed in said longitudinal planes;

at least a substantial portion of said transverse members defining a plurality of vertical transverse planes and being disposed in said transverse planes;

said vertical planes forming substantially horizontal rectangles on each deck and said bottom;

said horizontal load bearing elements being disposed such that at least some of said horizontal rectangles are disposed one above the other and aligned vertically;

said horizontal rectangles being disposed one above another for forming a plurality of adjacent vertical groups of rectangles, having rectangles within each said group aligned vertically one above another;

vertical access ways being disposed in at least some of sAid vertical groups of rectangles;

each of said access ways comprising access openings in said uppermost deck and at least in some of said lower decks in each corresponding vertical group;

an uppermost of said access openings of each said access way being at least as large as a lower one of said access openings in said corresponding access way in its corresponding vertical group;

second deck access openings of said access openings being directly under an uppermost of said openings of each of said vertical access ways in its corresponding vertical group;

said second deck access openings having means for receiving a water tight cover; and said uppermost of said access openings having a watertight load-bearing cover and an apparatus installed on said watertight cover, at least some of said lower deck access openings being provided with watertight load-bearing covers and including equipment bearing containers installed on at least some of said covers.

2. A ship according to claim 1 wherein said means for receiving a water-tight cover comprises means for receiving a cover comprising at least one piece.

3. A ship according to claim 2 wherein said means for receiving a cover being in at least one piece comprises means for receiving a cover being in at least two pieces.

4. A ship according to claim 2 wherein said access openings on said uppermost deck have means for receiving one-piece covers.

5. A ship according to claim 1 wherein said access openings on said uppermost deck have means for receiving one-piece covers.

6. A ship according to claim 5 wherein decks lower than an uppermost deck of said lower decks have a shortened partial cover in a first portion and an adapted cover in a second portion in each corresponding access opening.

7. A ship according to claim 6 wherein each said adapter has three sides for flush installation along in its access opening and on a fourth side a hatch beam for supporting one side of said partial cover.

8. A ship according to claim 6 wherein said partial cover and said adapter each have a short horizontal dimension, a ratio of said short dimensions being substantially 2 to 1.

9. A ship according to claim 1 wherein said ship has at least three decks and wherein said access openings of a group below its corresponding uppermost opening are of substantially equal size.

10. A ship according to claim 9 wherein access openings two decks below said uppermost deck have two-piece removable access covers.

11. A ship according to claim 10 wherein said two-piece removable access covers are water-tight when installed.

12. A ship according to claim 11 wherein said access openings on said uppermost deck have means for receiving one-piece covers.

13. A ship according to claim 1 wherein said longitudinal members and said transverse members are joined at a plurality of junction means and further including a plurality of vertical columns each connecting said plurality of junction means.

14. A ship according to claim 13 including shock absorbers disposed between said bottom and a portion of said vertical columns lying above said bottom.

15. A ship according to claim 13 wherein at least some of said vertical columns are temporarily removable.

16. A ship according to claim 13 including a plurality of bulkheads and wherein at least one vertical group being disposed between any two of said bulkheads.

17. A ship according to claim 16 including a bulwark and wherein said vertical columns comprise sole load bearing elements between said bulwark and said bulkheads.

18. A ship according to claim 17 wherein said ship has at least three decks and wherein said access openings of a group below its corresponding uppermost opening are of substantially equal size.

19. A ship according to claim 1 wherein said uppermost access openings of each of said vertical groups being larger than its corresponding lower access openings whereby a cover from a lower access opening will pass through said uppermost access opening.

20. A ship according to claim 19 wherein said apparatus comprises a naval deck unit, and wherein said uppermost access openings have upward projecting means for receiving a foundation for said naval deck unit.

21. A ship according to claim 20 wherein said access openings located in said lower decks each has an access opening having sides flush with and rigidly mounted to its corresponding deck.

22. A ship according to claim 21 wherein said ship has at least three decks and wherein said access openings of a group below its corresponding uppermost opening are of substantially equal size.

23. A ship according to claim 1 wherein a portion of said access openings being disposed along a longitudinal axis of said ship are all of substantially equal dimensions.

24. A ship according to claim 23 wherein said ship has at least three decks and wherein said access openings of a group below its corresponding uppermost opening are of substantially equal size.

25. A ship according to claim 1 wherein said decks have longitudinal and transverse reinforcements and covers with longitudinal and transverse reinforcements, all of said reinforcements of a deck and its covers lie in a plane, said longitudinal reinforcements of both said decks and said covers are substantially parallel, and said transverse reinforcements of both said decks and said covers are substantially parallel.

26. A ship according to claim 25 wherein said longitudinal and said transverse reinforcements intersect at intersection means and height adjusting means being disposed at said intersection means for vertical height adjustment of said intersection means.

27. A ship according to claim 26 including transporter rails disposed above said height adjusting means.

28. A ship according to claim 27 wherein said ship has at least three decks and wherein said access openings of a group below its corresponding uppermost opening are of substantially equal size.

29. In combination, an assembly arrangement for equipment and apparatus in a ship having a plurality of vertically-spaced decks and a ship bottom with a hull which has a longitudinal direction and a transverse direction, said arrangement comprising:

a plurality of substantially horizontal longitudinal load-bearing members supporting each said deck, including a top deck;

at least several of said plurality of longitudinal load-bearing members of each said deck lying in vertical planes in which lie correspondingly-located load-bearing members of other decks, so that each said deck contains a plurality of rectangles formed by said vertical planes;

each of said plurality of decks including rectangles which have vertically-aligned corresponding rectangles in other decks;

said vertically-aligned rectangles of said decks, at least at one location, including vertically-aligned access openings to form vertical shafts running from said top deck to at least a lower deck of said ship;

said arrangement including vertical columns disposed bridging superjacent decks in an area of each of at least one of said access openings;

an uppermost one of said access openings of at least one of said shafts being disposed on said top deck and having a watertight load-bearing cover on which is installed a naval deck unit;

at least one of said access openings, which are located on decks other then said top deck, including watertight load-bearing covers which are flush with associated deck surfaces and which are provided with equipment-bearing containers disposed thereon;

at least one of said vertical columns being provided with resilient means for shock absorption in a vertical direction;

at least one of said vertical columes being temporarily removable; and an uppermost access opening of each said shaft being larger than other access openings which are below said uppermost access opening.

* * * * *